US005184759A

United States Patent [19]

Gill et al.

[11] Patent Number: 5,184,759

[45] Date of Patent: Feb. 9, 1993

[54] APPARATUS FOR ELONGATING A BULK BAG AND A BULK BAG UNLOADING STATION INCORPORATING THE SAME

[75] Inventors: David R. Gill, Phillipsburg, N.J.; Larry J. Duca, Bethlehem, Pa.; Robert M. Badway, Easton, Pa.; Michael W. Walsh, Easton, Pa.; John F. Simonof, Easton, Pa.

[73] Assignee: Flexicon Corporation, Phillipsburg, N.J.

[21] Appl. No.: 695,700

[22] Filed: May 3, 1991

[51] Int. Cl.[5] ..... B67D 5/06

[52] U.S. Cl. ..... 222/181; 222/529

[58] Field of Search ..... 222/74, 95, 105, 181, 222/461, 462, 185, 526, 537, 529

[56] References Cited

U.S. PATENT DOCUMENTS

| | | | |
|---|---|---|---|
| 508,307 | 11/1893 | Haagen | 222/537 X |
| 2,858,051 | 10/1958 | Cunningham | 222/105 X |
| 3,372,725 | 3/1968 | Voorhees | 222/105 X |
| 3,961,655 | 6/1976 | Nattrass et al. | 222/181 X |
| 4,442,956 | 4/1984 | Carlsson | 222/185 |
| 4,449,646 | 5/1984 | Bonerb et al. | 222/105 X |
| 4,541,765 | 9/1985 | Moore | 222/95 X |
| 4,722,655 | 2/1988 | Bonerb | 222/105 X |
| 4,966,311 | 10/1990 | Taylor | 222/181 X |

*Primary Examiner*—Andres Kashnikow
*Assistant Examiner*—Kenneth Bomberg
*Attorney, Agent, or Firm*—Volpe and Koenig

[57] ABSTRACT

An improved bulk bag unloading station is disclosed. In its simplest form, the improvement is comprised of a movable dispensing spout which is attached to and depends from an outlet of the bulk bag. As material is dispensed through the spout, the moveable spout will cause the bulk bag to elongate. Through movement of the spout, the bag is continually elongated to continually urge the flow of material from the bulk bag and to promote full discharge of the material from the bag. In the preferred embodiment, a lift and hold apparatus is provided to position the spout during initial attachment to the outlet of the bag.

19 Claims, 3 Drawing Sheets

FIG. 1
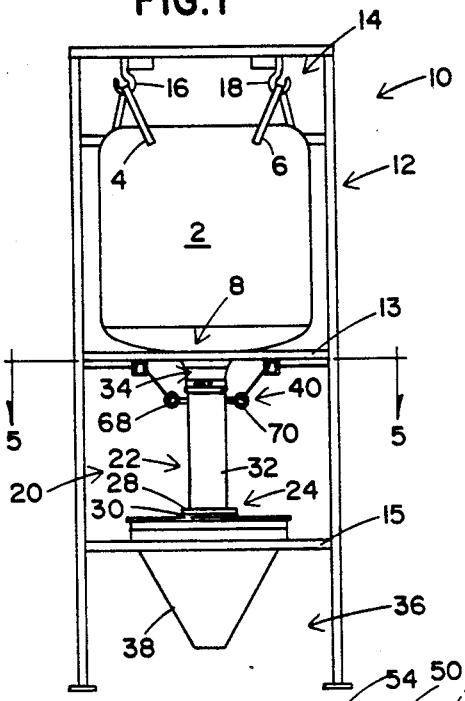
FIG. 2
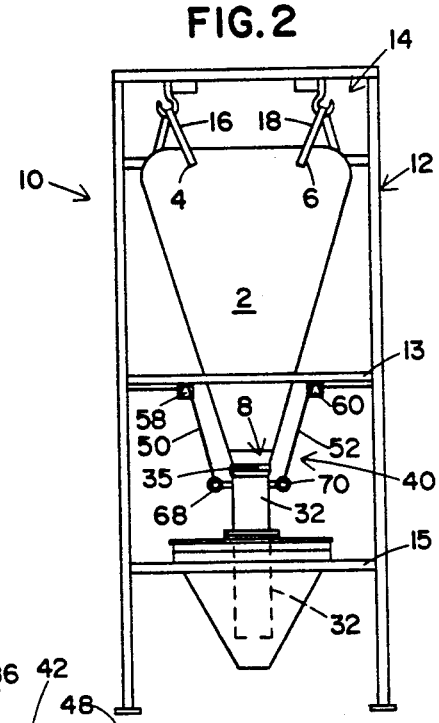
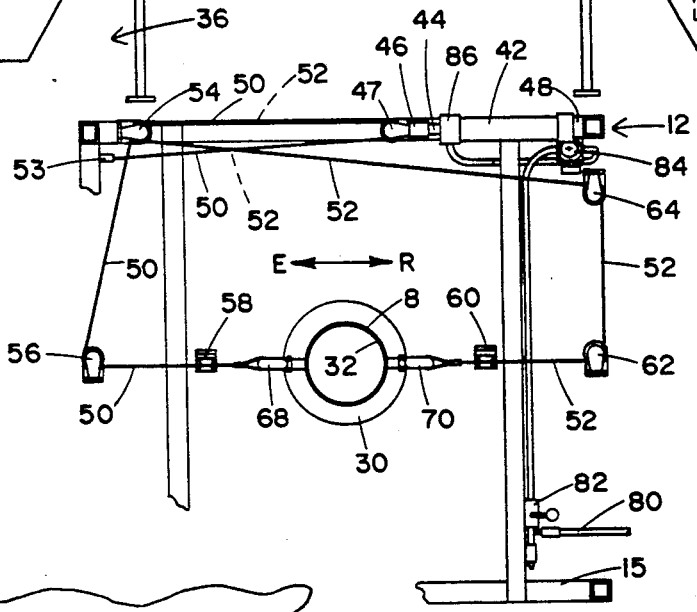
FIG. 5
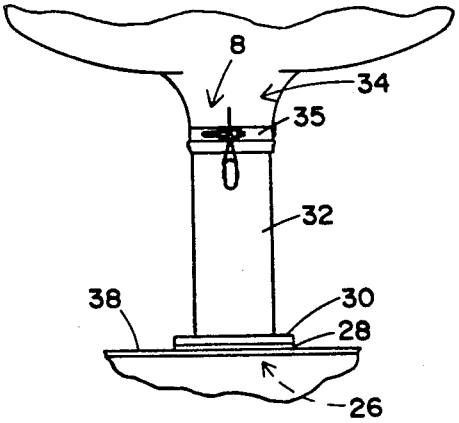
FIG. 3
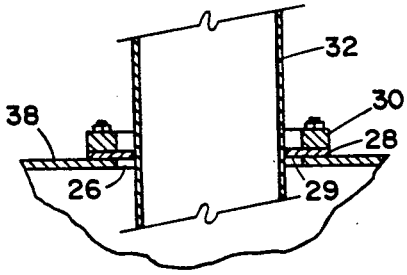
FIG. 4

FIG. 6
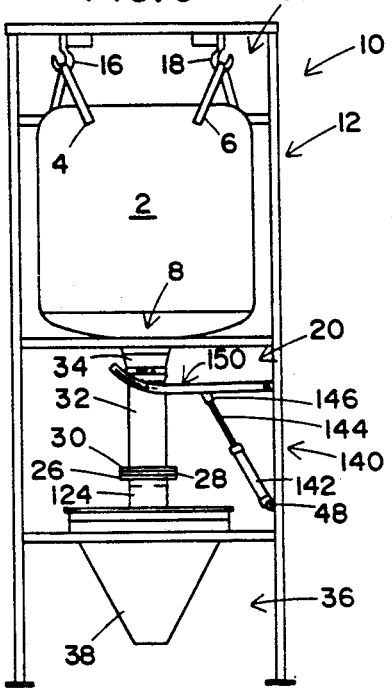
FIG. 7
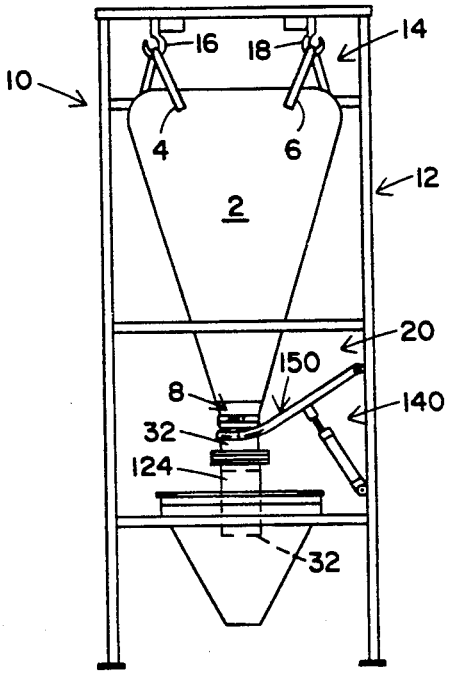
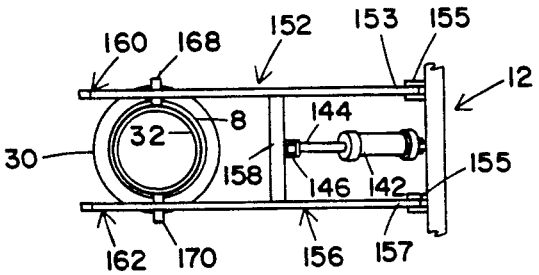
FIG. 10
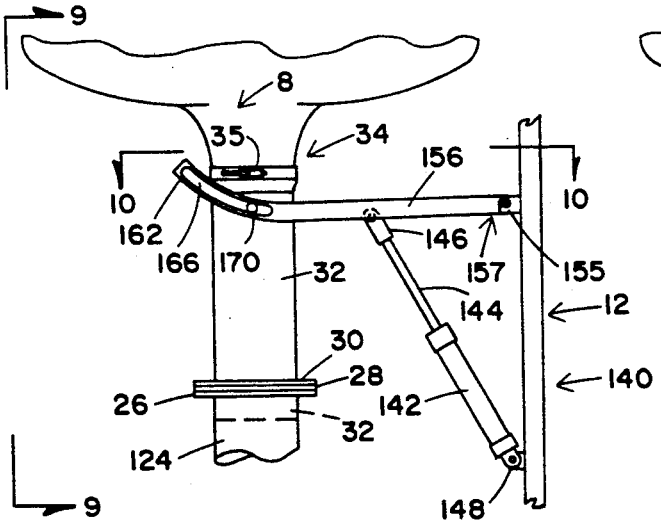
FIG. 8
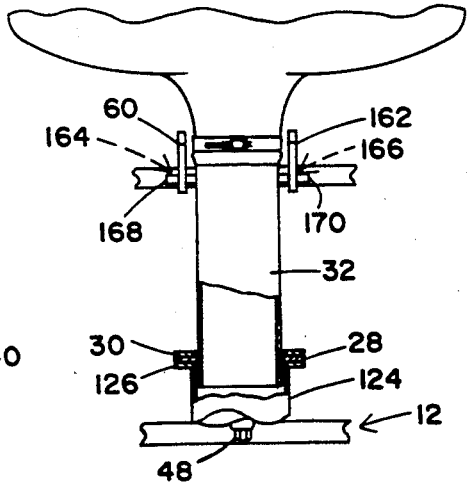
FIG. 9

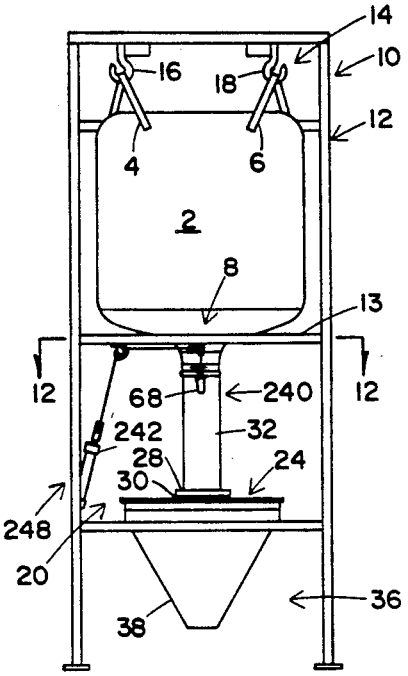
FIG.11
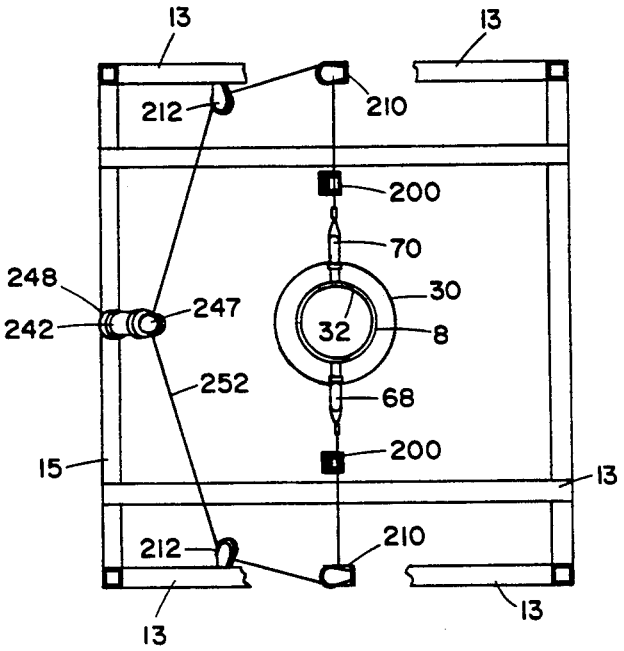
FIG.12
FIG.13
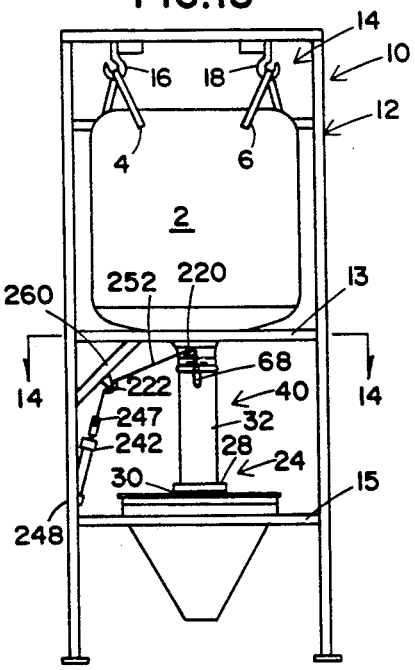
FIG.14
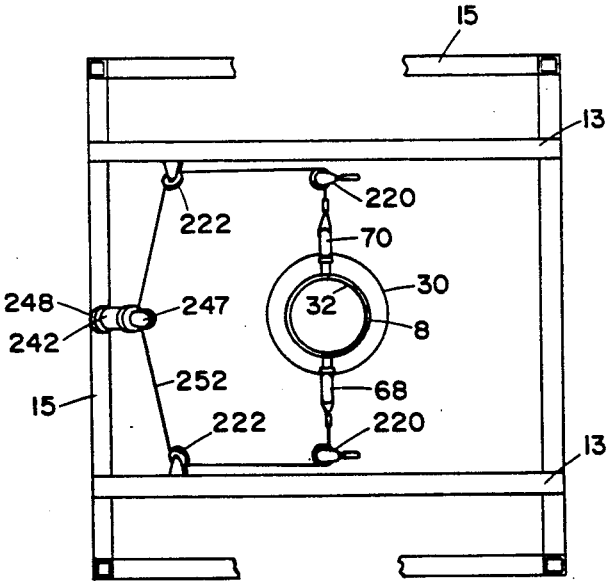

APPARATUS FOR ELONGATING A BULK BAG AND A BULK BAG UNLOADING STATION INCORPORATING THE SAME

BACKGROUND OF THE INVENTION

1. Field of the Invention

The present invention is intended for use in the unloading of bulk bags used as containers for particulate materials. The present invention is particularly intended for use in unloading bulk bag containers filled with dry or moist materials. The present invention is most particularly intended for use with bulk bag containers fabricated from cloth like material, such as woven polyester material, which is usually sewn in a cubicle configuration.

2. Description of the Prior Art

Bulk bags made of heavy cloth material have been known in the prior art for some time. It has also been known to provide one surface of the bag with heavy corner straps which will support the bag when it is hung in a tower like supporting frame. It has also been known to provide an opposite surface of the bag with a central cylindrical outlet which is closed by draw and tie strings.

Typically, the bulk bags may hold about 2,000–2,500 pounds; however, it is not uncommon to have bulk bags which are much heavier or much lighter. One standard bulk bag, commonly called a one ton bag, is about 64 cubic feet in volume.

The bag is generally sized to fit on a standard pallet and the actual weight of the bag will depend on the density of the contained material. When the bag is hung in the support frame and emptied, the sides begin to move in and straighten out during discharge of the material. At some point during the discharge, the side walls begin to collapse and the bag will elongate to a conical configuration. While this is a preferred result, the desired elongation does not always happen naturally. The failure to elongate into the desired cone configuration is particularly troublesome when the bulk material is a powder or other non-free flowing material. The failure to flow into the desired cone configuration typically results in inefficiency and often prevents total discharge of the bulk materials.

One additional factor which contributes to the difficulty of unloading a bulk bag is the material's angle of repose. As the angle approaches 90°, the material becomes more difficult to unload since it tends to stack rather than flow to the opening. By way of comparison water may be thought of as having a zero angle of response. Thus, water flows freely and tends to seek its own level.

Despite the fact that bag elongation has been a desirable characteristic of the unloading process, the prior art has not generally addressed this element of the process. In the past there have been efforts to accomplish bag elongation by raising the bulk bag via the lifting straps while maintaining the bag outlet in a fixed position. While this effort recognized the desirability of elongating the bag, it has proven to be less cost effective than desired and requires substantial modifications of the supporting frame within which the bag is hung.

Despite the above effort at bag elongation, most bulk bag unloading systems do not include such an elongation system. In one common system, the cylindrical outlet or discharge spout of the bulk bag is placed in a very shallow walled hopper and the entire hopper and bag are vibrated or gyrated. In another system, the cylindrical outlet spout of the bulk bag is placed on a rocker mechanism which also supports the bag. Both of these prior art attempts seek to discharge all of the material, however, neither approach allows the bag to elongate. None of the prior art approaches fully addresses the problems associated with the angle of repose. As a result, the prior art creates poor flow characteristics and problems with pockets of residual material within the bags. As one alternative to the prior art, the bulk bag can be held over a totally open receiving vessel and the materials discharged without any effort to control the flow through an outlet spout. While this latter course may be acceptable with some materials, it is not considered a generally workable solution to the problem. The rapid discharge of material without control over the flow can create severe area dusting and atmospheric contamination problems which are environmentally unacceptable and/or create problematic ambient air conditions in the workplace.

In view of the above, it was concluded that the art desired a practical, efficient means for elongating a bulk bag container at an unloading station while maintaining control over the dispensed material.

SUMMARY OF THE INVENTION

The present invention provides container elongation means, a lift and hold apparatus and an unloading station which incorporates the same. The container is suspended in a supporting frame with the outlet of the container affixed to a movable dispensing spout which is suspended from and elongates the bag.

In the preferred embodiment, the movable dispensing spout is an elongated tubular spout which is attached to the outlet of the bulk bag. The weight of the tube is such that it will fall under the effects of gravity and pull the bag downwardly into the desired conical configuration.

In the preferred embodiment of the lift and hold apparatus, the spout is raised to the initial bag level through a cable array which is connected at eyelets on either side thereof. The cable array is controlled by a pneumatic cylinder.

In the alternative embodiment, the movable dispensing spout is also elongated and tubular. In this embodiment, the apparatus for raising the spout portion is comprised of at least one pivot arm which extends between the supporting frame and the spout. Affixed to the pivot arm is a cylinder assembly which includes a piston that is movable between a first and a second position. The cylinder is fixed at one end thereof to the frame and at the other end thereof to the pivot arm. As the piston moves through its range of travel, it causes corresponding movement in the pivot arm and the dispensing spout. As the elongated spout portion moves away from its initial position it causes a corresponding elongation in the bulk bag.

As a result of the elongation, the bag assumes a conical shape and the material is effectively and efficiently dispensed.

BRIEF DESCRIPTION OF THE DRAWINGS

FIG. 1 illistrates an unloading station with a movable dispensing spout in accordance with the preferred embodiment; the bag is shown in its full position.

FIG. 2 illustrates the preferred embodiment of the invention as shown in FIG. 1 after the bag has been elongated.

FIG. 3 is an enlarged view of the dispensing spout of FIG. 1 rotated 90°.

FIG. 4 is an enlarged view of the interface between the dispensing spout and the dispensing hopper.

FIG. 5 is a view taken along the line 5—5 of FIG. 1 and shows the details of the cable and pneumatic cylinder arrangement of the preferred embodiment.

FIG. 6 illustrates a typical unloading station incorporating an alternative embodiment of the invention; the bag is shown in its full position.

FIG. 7 illustrates the invention of FIG. 6 after the bag has been elongated.

FIG. 8 is an enlarged view of the movable spout and elongation apparatus according to this embodiment of the invention.

FIG. 9 is an enlarged view of the interface between the movable spout and the tube found on the typical dispensing hopper.

FIG. 10 is a view taken along the line 10—10 of FIG. 9.

FIG. 11 illustrates an alternative embodiment of the cable array.

FIG. 12 is a section taken through the line 12—12 of FIG. 11.

FIG. 13 illustrates another alternative embodiment of the cable array.

FIG. 14 is a section through the line 14—14 of FIG. 13.

DESCRIPTION OF THE PREFERRED EMBODIMENTS

The embodiments will be described with reference to the drawing figures wherein like elements are identified by the same numeral in all views.

With reference to FIG. 1, there is shown a bulk material container or bag 2 with support straps 4 and 6 secured on the surface thereof. Opposite the surface having the support straps, the bag 2 is provided with an outlet port 8. The bag 2 is mounted in a bulk bag unloading station 10 which is generally comprised of a supporting frame 12. The supporting frame 12 will be known to those skilled in the art and is generally configured of four vertical posts with a number of cross supports which will provide a tower like structure for holding the bag 2. The bulk bag unloading station 10 has a top or bag support end 14 which is illustrated as having shank hooks 16 and 18 for supporting the bag 2. At about the center or midpoint of the bulk bag unloading station 10, there is a discharge area 20. It is in the discharge area 20 where the present invention is applied. Beneath the discharge area 20, near the bottom of the unloading station 10, there is a dispensing area 36 which includes the dispensing hopper 38.

By comparing FIGS. 1 and 2 it is possible to see the desired bag elongation and the different positions of the lift and hold apparatus 40 and the elongated spout 32. The lift and hold apparatus 40 provides a means for positioning movable spout 32 for attachment to the outlet 8 of bag 2; upon release of apparatus 40 the spout 32 will depend from outlet 8 and will be retained in the desired position with respect to hopper 38 by guide 24. Although it may be generally expected that the egress of material through the outlet 8 would cause the desired bag elongation, experience has shown that material will frequently empty out as a column above the outlet 8. When this happens, often as a result of the material's angle of repose, a resulting hollow is established through the center of the material in the bag 2 and the remaining material defines the hollow. Accordingly, it is necessary to provide some means for disrupting the steady state of the material to continue the flow and/or to elongate the bag so that the side walls of the bag continue to exert an inward pressure on the remaining material.

With reference to FIGS. 3 and 4, the relationship between guide 24 and the elongated movable dispensing spout 32 will be more fully described. The guide 24 includes a circular aperture 26, formed directly in the top of hopper 38, with an interior diameter which is larger than the exterior diameter of spout 32. A gasket 28 and a flange 30 seal the aperture 26. Through the assembly of the ring gasket 28 and flange 30 against the hopper 38, the interface between guide 24 and spout 32 is essentially sealed against unwanted discharge of material as the bag 2 is being emptied. The gasket 28 has an interior opening which is slightly less than the exterior diameter of the spout 32. This causes an interference or wiping fit between the gasket 28 and spout 32. The lip 29 of gasket 28 is tapered or accurately shaped to facilitate vertical movement of the spout 32 without damage to gasket 28.

With reference to FIGS. 1 and 2, elongated movable dispensing spout 32 is connected to the bag outlet 8 at the bag outlet clamping area 34. The elongated spout 32 fits within the guide 24 and has a length sufficient to accommodate full extension of the bag 2 from the full to empty positions. The length of the elongated movable dispensing spout 32 will be at least equal to the distance that bag 2 travels in the discharge area 20. In the preferred embodiment, the movable dispensing spout 32 is about two feet long, is fabricated from steel, preferably stainless, and weighs about 25 lbs. Such a spout weight, in combination with the natural agitation afforded by the egress of material, is sufficient to cause the movable spout 32 to descend under the influence of gravity as material is emptied. Other dense materials, natural and synthetic, may be used and the actual weight of the movable spout will depend to some extent on the resistance of the bag material and the angle of repose for the dispensed material. In its simplest form, the movable spout merely depends from the bag outlet 8 and is positioned by guide 24.

Still with reference to FIGS. 1 and 2, it can be seen that, in the preferred embodiment, the movable elongated spout 32 is provided with lifting and holding means 40. Two eyelets 68 and 70 are connected to are positioned on either side of the spout 32 just beneath the bag clamping area 34 or about six inches from the end of movable spout 32. The eyelets 68 and 70 are positioned on either side of the spout 32 so as to be on the centerline of the spout. Each of the eyelets has an interior diameter which is sufficient to accommodate a cord or cable 50, the arrangement of which will be described more fully hereinafter.

In general, the lift and hold apparatus 40, in this embodiment, is responsible for retracting the movable spout 32 to its uppermost position adjacent bag clamping area 34 and holding it during attachment of the outlet 8 via the clamp 35. This arrangement means that the movable spout 32 will be held in the necessary position with respect to bag outlet 8 for safe securement of the clamp 35. As will be known to those skilled in the art, the outlet 8 is generally closed by a drawstring which is removed, after attachment, to initiate discharge.

By comparing FIGS. 1 and 2, it can be seen that movable spout 32 and lift and hold apparatus 40 will change position as the bag 2 is elongated. In this embodiment, the elongation takes place as a consequence of the gravitational pull on the spout 32 when apparatus 40 is released from the hold position. As noted above, it is the primary function of the presently preferred apparatus 40 to position the spout 32 at the start of the unloading operation and then to release the movable dispensing spout 32 to the resistance of the outlet 8.

As noted previously, the eyelets 68 and 70 are generally on centerline with each other and are disposed at the end of the dispensing spout proximate to the bag clamping area 34. In the preferred embodiment, the cables 50 and 52 translate the desired movement to the spout 32; the arrangement of cables 50 and 52 will be explained in more detail below with reference to FIG. 5.

Before turning to FIG. 5 for a detailed explanation of the lift and hold apparatus 40, it will be beneficial to refer again to FIG. 1 to consider the environment. As noted previously with reference to FIG. 1, the supporting frame 12 will have a tower like structure. Between the bag support end 14 and the discharge area 20, there is a rectangular framing array 13. The rectangular framing array helps to support the structure and also provides the necessary frame work on which to support the pulleys and cylinders which are associated with apparatus 40. Likewise, the lower frame section 15 provides a structure for holding the dispensing hopper 38.

With reference to FIG. 5, lift and hold apparatus 40 will be described in more detail. As noted previously with reference to FIG. 1, the framing member 13 is positioned above the bag clamping area 34. The elements of framing member 13 are spaced apart a sufficient distance to allow full elongation of the bag 2 without interference from the cross members 13, see FIG. 2. Keeping in mind the fact that the frame supports the various elements, see FIGS. 1 and 2, the apparatus 40 will be described in more detail with reference to FIG. 5. An actuator, such as fluid actuated cylinder 42 is mounted on the frame 12 via the mount 48. At the free end of cylinder 42, the rod 44 is secured to the yoke 46. Secured to yoke 46 is the double pulley assembly 47. The pulley assembly 47, in this embodiment, is a single frame, double wheeled pulley with each level accommodating a respective cable 50 or 52. Positioned opposite double pulley 47 is another double pulley assembly 54 which will accommodate a respective cable 50 or 52 on each wheeled level. Also associated with the cable 50 are the pulleys 56 and 58. Pulleys 58 and 60 are vertically disposed; all other pulleys are horizontally disposed. Cable 50 is secured at a first free end to eyelet 68. It then passes over the vertically disposed roller 58, around the horizontally disposed roller 56, around one of the rollers in the double pulley assembly 54, around one of the rollers in the double pulley assembly 47 and then returns back in the direction of pulley 54 and is secured at the other free end to the frame 12 at point 53. Cable 50 maintains essentially the same horizontal plane after it passes roller 58. In a like manner, cable 52 passes over vertical roller 60, around horizontal rollers 62 and 64, around the remaining wheeled rollers in each of the double pulley assemblies 54 and 47 and is similarly secured at point 53. As will be understood by those skilled in the art, the cables 50 and 52 are strung so as not to cross or interfere with each other. Both cables 50 and 52 are routed around the respective wheel in pulley assemblies 54 and 47 so as to form a double loop prior to termination at point 53.

By providing the doubled back configuration, each increment of movement for the rod 44 could, ideally, result in double the movement for the elongated spout 32. For example, eight inches of movement for rod 44 could translate into sixteen inches of movement for the spout 32. This is particularly useful in an environment where the available travel length for the rod 44 is limited.

Due to the angles that result from the actual cable route, see FIGS. 1, 2 and 5, the actual multiple is slightly less than two and the vertical movement is approximately fourteen inches. This is a lift ratio of about 1.75 to 1. The minimum lift ratio is expected to be about 1.5 to 1.

As noted previously, the spout 32 will move vertically in response to the extension or retraction of the rod 44. When it is desired to retract the spout 32 to its uppermost position, see FIG. 1, the rod 44 is retracted into the cylinder 42, direction R as shown in FIG. 5. When the rod 44 is permitted to extend out from the cylinder 42, direction E as shown in FIG. 5, the spout 32 is permitted to move downwardly. Once spout 32 has been attached to the outlet 8 of bag 2, its downward movement will be influenced by the bag's resistance to elongation.

At this point, it may be beneficial to discuss the function of cylinder 42. In the preferred embodiment, cylinder 42 is a fluid pressure cylinder which is air operated. One suitable cylinder is available from the Aro Corporation of Bryan, Ohio 43506-0151, under model no. 3920-1009-2-080. Air supply so is secured to the air switch 82. Air switch 82 will control the application and release of pressure to the cylinder 42. Prior to being applied to cylinder 42, the air is passed through a filter 84. In the preferred embodiment, the air is applied to the forward end 86 of cylinder 42. When switch 82 is in the on position, air will be applied through end 86 and the rod 44 will be driven back into the cylinder. This causes retraction of the pulley assembly 47 and lifting of the movable spout 32. As long as switch 82 remains in the on position, the dispensing spout 32 will remain in the up position. After attachment of the bag, the switch 82 may be moved to the off position which will then permit downward movement of the spout 32. Depending upon the application, the off position may or may not result in a direct release of air pressure. In some applications, it may be preferable to simply permit the air to bleed off as pressure is applied to the rod 44 due to downward movement of movable dispensing spout 32. In other applications, it may be preferable to have a biasing spring which must be collapsed by the extension of rod 44 and extends as a result of downward movement of dispensing spout 32. Likewise, it may be desirable to have a slow bleeding off of the fluid pressure during retraction of rod 44 as a result of downward movement of movable spout 32. As a general matter, those skilled in the art will understand and appreciate that the release of fluid pressure will depend on the application. In general, it is desirable to maintain some tension on the cables 50 and 52 so as to avoid slack cables and the like. Those skilled in the art will recognize the value of maintaining the cables in the desired position so that they may be easily tensioned by activation of the cylinder 42.

As will also be understood by those skilled in the art, the length of the movement of cables 50 and 52 must be such that the movable dispensing spout 32 will be in the desired upper position at the start of the process. Similarly, the extension of piston 44 must be selected so as to correspond to the desired length of downward travel of the spout 32.

With reference to FIG. 4, the sealed interface between the hopper 38 and elongated spout 32 can be seen more clearly. As noted previously, hopper 38 has a circular aperture which is larger than the spout 32. The gasket 28 is secured to hopper 38 by the flange 30 through a series of fasteners. The gasket 28 has a curved or arcuate inner surface to provide a smooth interface with elongated spout 32 as it moves up and down through the gasket. In addition to sealing the spout 32, gasket 28 maintains the position of and guides the movable spout 32. In its simplest form, movable dispensing spout 32 will be secured to and depend from the outlet spout 8 and the bag 2 and will be guided in its vertical movement by the gasket 28. In the preferred embodiment, gasket 28 is white nitrite having a Shore durometer in the range of 50–60.

With reference to FIGS. 6 through 9, an alternative embodiment of the invention will be described. As in the prior embodiment, spout 32 is connected to the outlet 8 at the bag outlet clamping area 34. The elongated spout 32 is dimensioned to fit within the guide spout 124. Spout 124 is a modification of the preexisting bag connection tube which is available on many prior art hoppers. In the prior art, spout 124 included an area for clamping the outlet 8 directly to the spout. In accordance with the present invention, the prior art spout is modified to provide a sealed interface between it and the elongated spout 32. This will be described in more detail hereinafter.

Referring to FIGS. 6 and 7, two roller pins 168 and 170 are connected to the spout 32 just beneath the bag outlet clamping area 34. The roller pins 168 and 170 fit within the arcuate slots of the pivot arms 152 and 156. In general, the pivot assembly 150 is comprised of two pivot arms, 152 and 156, having arcuate ends, 160 and 162, which are slotted, 164 and 166, to receive the roller pins, 168 and 170, a cross member 158, which fixes one pivot arm relative to the other, and two pivot points, 153 and 157, pinned to the yokes 155 which are affixed to the frame 12. The pivot assembly 150 is rotated in response to the actuation of cylinder 142, which is connected to the cross member 158 of the assembly 150 by the yoke 146 and to the frame 12 by the mount 148. As the piston 144 is extended or retracted by the cylinder 142, the pivot assembly will translate that motion to vertical movement of the spout 32. As in the prior embodiment, cylinder 142 is controlled by a switching device and has a filtered air supply.

With reference to FIG. 8, the apparatus 140 is described in more detail. As noted previously, roller pin 170 is affixed to the spout 32 approximate to the bag outlet clamping area 34. The roller pin 170, like eyelet 70, is located a sufficient distance from the end of the spout 32 to permit full attachment and securement of the outlet 8 to the spout 32 with clamp 35. Flange 126 is provided as a mate for flange 30. As with the prior embodiment, a gasket 28 is provided between flanges 126 and 30. Once again, the length of spout 32 is determined by the starting position of the bulk bag container 2, as shown in FIG. 6, and the amount of extension which is required to reach the elongated configuration, as shown in FIG. 7. As shown in FIG. 10, it is preferable to provide opposed roller pins 168 and 170 on spout 32. Returning to FIG. 8, the pivot arm 156 is pivotally mounted to the yoke 155 at end 157. Yoke 155 is secured to the frame 12. The connection between end 157 and yoke 155 is made via a pivot pin. The arcuate end 162 of pivot arm 156 has a slot 166 which complements the pin 170. As a result of the fixed pivot point at end 57 and the cooperation of slot 166 and pin 170, rotation of the pivot arm in a clockwise or counterclockwise movement causes a vertical displacement of the elongated spout 32.

With reference to FIGS. 9 and 10, it can be seen that this embodiment utilizes opposed pivot arms 152 and 156 on the telescoping spout 32. Arcuate end 160, slot 164 and pivot pin 168 correspond directly to their opposite counterparts 162, 166, and 170 respectively. With reference to FIG. 10, it can be seen that this embodiment provides for balanced elongation. The pivot arms 152 and 156 are connected by the cross member 158. As a result, the pivot assembly 150 has an "H" configuration. The pivot assembly 150 rotates about the pivot points established by ends 153 and 157 with frame 12 and translates the arcuate movement of the pivot arms 152 and 156 into vertical motion of the telescoping spout 32 via the pins 168 and 170. Piston 144 is pivotally connected to the cross member 158 at yoke 146. Piston 144 operate s in response to cylinder 142. In this embodiment, the apparatus may be used to positively lower the spout 32. With the use of a double acting cylinder, rod 144 will hold the spout 32 in the up position when extended and then urge spout 32 downwardly when rod 144 is retracted into cylinder 144.

Alternatively, the weight of apparatus 140 may be established at a desired level so that a bleeding off of the fluid pressure will cause it to fall under gravity with only the bag as an opposing force.

With reference to FIG. 11, there is shown another alternative embodiment of the bulk bag unloading station 10. The unloading station 10 of FIG. 11 is substantially identical to that of FIG. 1, however, the lift and hold apparatus 240 of FIG. 11 differs from that in FIG. 1. In describing the present embodiment, those elements which are common with the disclosure of FIG. 1 will bear the same numeral. All new or modified elements are identified by newly assigned numerals.

With reference to FIGS. 11 and 12, the cylinder 242 is mounted on the side of the bulk bag unloading station 10. The cylinder 242 is secured at its base to a cross member 15 by the mount 248. The cylinder 242 is pivotally mounted so that it may move toward and away from the spout 32. However, the cylinder 242 is generally held against side to side movement so that it is maintained in the same vertical plane. As explained in accordance with the prior embodiment, the cylinder includes a piston rod which will extend and retract in accordance with the desired movement of the spout. This movement is translated through the pulley 247 and the cable 252.

With reference to FIG. 12, the present embodiment includes a number of pulley assemblies which are secured to the bulk unloading station 10. Each of the pulleys 200, 210 and 212 is an enclosed pulley which will capture the cable 252 within the pulley assembly. This capture of the cable is desirable since each of the pulleys 200, 210 and 212 is mounted so as to rotate or pivot on the frame. Stated in another way, the pulleys are not rigidly mounted to the bulk bag unloading station 10. Rather, the pulleys are permitted to move or rotate so as to reduce the friction or tension on the cable 252. The pulleys 200 are mounted on opposite sides of the spout 232 and are positioned to control vertical movement of the cable 252 as the spout 32 is raised and lowered. The pulleys 210 are mounted under the cross member 213. These pulleys will be permitted to move in the vertical plane and are positioned to alter the direction of the cable 252 from the center line of the spout 32 toward the side on which the cylinder 242 is mounted. The pulleys 212 are mounted on the frame and have a generally angular disposition so as to direct the cable 252 downwardly toward the pulley 247. As can be seen from FIG. 12, the cylinder 242, the cable 252 and the pulleys 210 and 212 will form a modified Y configuration. As noted previously, pulleys 200, 210 and 212 are permitted some movement, however, they will generally maintain the configuration depicted in FIG. 12.

For this embodiment, extension of the piston rod from the cylinder 242 results in free cable and downward movement of the spout 32. Retraction of the piston rod results in lifting of the spout 32. It will be understood by those skilled in the art that the pulley assemblies 200, 210 and 212 must be spaced by a distance sufficient to permit complete elongation of the bulk bag 2. See FIG. 2.

With respect to FIG. 13, there is shown a further embodiment of the present invention utilizing cables and pulleys. Once again, the basic unloading station 10 is similar to that described in FIG. 1. In addition, a number of the elements in this embodiment are common with the prior embodiment described in connection with FIGS. 11 and 12. Accordingly, elements common to those described in connection with FIGS. 11 and 12 will bear common numerals.

With respect to the differences of this embodiment, it will be noted that this embodiment utilizes fewer pulleys than the previously described embodiment. In this embodiment, the pulleys 220 are freely rotatable and are disposed so as to be on the center line with spout 32 and will extend the cable 252 along that center line. As can be seen from FIG. 13, the cable will pass around the pulleys 220 and angle downwardly toward the pulleys 222. Each pulley 222 is mounted on the angular support frame 260 which has been added to the bag support station 10. The frames 260 are positioned directly beneath the cross members 13 and do not interfere with elongation of the bag. As can be seem from FIGS. 13 and 14, the cable 252 will pass around the pulleys 222 and through the pulley 247. As with prior embodiments, extension and retraction of the piston in cylinder 242 will result in raising or lowering of the spout 32. Once again, those skilled in the art will appreciate that the pulleys 220, 222 and 247 must be positioned to permit full bag elongation.

The use of non-rigid mounting for the pulleys 220 and 222 and the cylinder 242 permits some self adjustment in the cable and pulley system and is believed to provide two advantages. In the first instance, stress on the cable 252 is relieved. In the second instance, it provides a more flexible retrofit to existing bulk bag unloading stations which may not permit exact location of fixed pulley assemblies.

We claim:

1. An improved bag dispensing station of the type having a vertically oriented supporting frame that includes spaced apart bag supporting, discharging and dispensing sections, the bag supporting section including means for suspending a bulk bag with an outlet portion of said bag depending downwardly toward the discharging section, said discharging section including a spout for attachment to the outlet of said bag, said dispensing section including a hopper for receiving material dispensed from the bag, the improvement being:

said spout being a movable, rigid dispensing spout which is movably positioned in the discharge section and depends from the outlet portion of the bag; the entire dispensing spout movable toward the hopper to causes bag elongation during material discharge.

2. A bulk bag dispensing station comprising:

a vertical frame having a bulk bag support area and a discharge area, the bag support area supports a bulk bag with an outlet portion depending downwardly toward the discharge area, the discharge area includes a moveable dispensing spout which is attached to the outlet portion;

an actuation means which is secured to the frame and is movable between a first position and a second position; and movement translation means which is connected to the dispensing spout, responsive to the movement of the actuation means and translates the movement of the actuation means into vertical displacement of the moveable dispensing spout.

3. An apparatus for elongating a bulk bag suspended in a supporting frame, said bag having bag support means and an outlet means, said apparatus comprised of:

a movable dispensing spout;

at least one pivot arm extending between the supporting frame and the dispensing spout;

at least one actuation means extending between the supporting frame and the pivot arm for moving the pivot arm, said actuation means having first and second ends, with one of the ends being movable between a first position and a second position; whereby, movement of the one end of the actuation means between the first and second positions causes corresponding movement of the pivot arm and vertical movement of the outlet means.

4. An apparatus for elongating a bulk bag suspended in a supporting frame with a bulk bag outlet means affixed to a movable dispensing spout, said apparatus comprised of:

said movable dispensing spout;

at least one pivot arm extending between the frame and the dispensing spout;

at least one fluid actuated cylinder having a first end and a second end, said second end including a piston movable between a first position and a second position, said cylinder being affixed at the first end to the frame and the movable piston being affixed to the pivot arm; whereby, movement of the piston between the first and second positions causes displacement of the pivot arm and vertical movement of the movable dispensing spout.

5. An improved bag dispensing station of the type having a vertically oriented supporting frame that includes spaced apart bag supporting, discharging and dispensing sections, the bag supporting section including means for suspending a bulk bag with an outlet portion of said bag depending downwardly toward the discharging section, said discharging section including a dispensing means for attachment to the outlet of said bag, said dispensing section including a hopper for receiving material dispensed from the bag, the improvement being the dispensing means comprising:

an elongated, rigid dispensing spout, having a length at least equal to the distance between the bag outlet and the dispensing section, the rigid dispensing spout secured to and depending from the outlet portion of said bag; the entire dispensing spout movable toward the hopper and causes the bulk bag to elongate as the dispensing spout descends during material discharge.

6. An apparatus for elongating a bulk bag suspended in a supporting frame by a bag supporting means, said bag having an outlet means which is opposite the bag supporting means, said apparatus comprised of:

a movable spout having an end for attachment to the outlet means;

at least one pivot arm extending between the supporting frame and the movable spout;

at least one actuation means extending between the supporting frame and the pivot arm, said actuations means being movable between a first position and a second position; whereby, movement of the actuation means between the first and second positions results in vertical movement of the movable spout.

7. An apparatus for elongating a bulk bag suspended in a supporting frame by a bag support means with an opposing bag outlet means affixed to a dispensing spout, said apparatus comprised of:

at least one pivot arm extending between the frame and the dispensing spout;

at least one fluid actuated cylinder having a first end and a second end, said second end including a piston movable between a first position and a second position, said cylinder being affixed at the first end to the frame and the movable piston being affixed to the pivot arm; whereby, movement of the piston between the first and second positions permits movement of the pivot arm, downward displacement of the dispensing spout and elongation of the bulk bag.

8. A bulk bag dispensing station comprising;

a vertically oriented supporting frame having a bag supporting area, a discharge area and a dispensing area, the bag supporting area including means for suspending a bulk bag in the frame with an outlet portion of said bag depending downwardly toward the discharge area;

a movable dispensing spout having means for attachment to the outlet of the suspended bag;

movement translation means extending between the supporting frame and the spout;

at least one fluid cylinder having a first end and a second end, said second end including a movable member which is movable between a first position and a second position, said cylinder being affixed at the first end to the frame and the movable member being affixed to the movement translation means; whereby, vertical movement of the spout is determined by displacement of the movable member between the first and second positions.

9. The improvement of claim 1 further comprised of:

an actuation means which is secured to the frame and is movable between first and second positions; and movement translation means which is secured to the spout, responsive to the movement of the actuation means and translates the movement of the actuation means into vertical displacement of the movable dispensing spout.

10. The improvement of claim 9 wherein the movement translation means is a continuous length of cable having opposite ends which are connected to the dispensing spout on opposite sides thereof.

11. The improvement of claim 10 wherein the actuation means is a gas operated cylinder.

12. The improvement of claim 11 wherein the gas operated cylinder is mounted on the frame at a position which is centrally disposed between the connections of the cable ends to the dispensing spout.

13. The improvement of claim 9 wherein the actuating means is a gas operated cylinder.

14. The improvement of claim 1 further comprised of means to lift and hold the dispensing spout.

15. The improvement of claim 1 wherein the movable, rigid dispensing spout has a weight of at least twenty-five (25) pounds.

16. The improvement of claim 15 further comprised of means to lift and hold the dispensing spout.

17. The improvement of claim 1 further comprised of:

actuation means which is secured to the frame and is movable between first and second positions; and movement translation means which is comprised of two lengths of cable each length having a central portion which is connected to the actuation means, a first end which is attached to the frame and a second end is attached to the movable dispensing spout; whereby, the movement translation means responds to movement of the actuation means and translates movement of the actuation means into vertical displacement of the moveable dispensable spout.

18. The improvement of claim 17 wherein the actuation means is a gas operated cylinder.

19. The improvement of claim 18 wherein the gas operated cylinder is an air cylinder.

* * * * *